US008294365B2

(12) United States Patent
Nasu et al.

(10) Patent No.: US 8,294,365 B2
(45) Date of Patent: Oct. 23, 2012

(54) PLASMA DISPLAY PANEL

(75) Inventors: Shougo Nasu, Hyogo (JP); Hisayo Oohata, Osaka (JP); Kenji Sato, Osaka (JP); Syouzou Ninomiya, Osaka (JP); Kenji Hasegawa, Osaka (JP)

(73) Assignee: Panasonic Corporation, Osaka (JP)

( * ) Notice: Subject to any disclaimer, the term of this patent is extended or adjusted under 35 U.S.C. 154(b) by 4 days.

(21) Appl. No.: 12/918,175

(22) PCT Filed: Sep. 17, 2009

(86) PCT No.: PCT/JP2009/004682

§ 371 (c)(1),
(2), (4) Date: Aug. 18, 2010

(87) PCT Pub. No.: WO2010/032469

PCT Pub. Date: Mar. 25, 2010

(65) Prior Publication Data

US 2011/0006665 A1 Jan. 13, 2011

(30) Foreign Application Priority Data

Sep. 17, 2008 (JP) ..... 2008-237384
Sep. 17, 2008 (JP) ..... 2008-237385
Sep. 17, 2008 (JP) ..... 2008-237386
Sep. 17, 2008 (JP) ..... 2008-237387

(51) Int. Cl.
*H01J 17/49* (2012.01)

(52) U.S. Cl. ..... 313/587; 313/586

(58) Field of Classification Search ..... 313/582–587
See application file for complete search history.

(56) References Cited

U.S. PATENT DOCUMENTS

| | | | | |
|---|---|---|---|---|
| 2002/0089284 | A1 | 7/2002 | Hayashi | |
| 2006/0238102 | A1 * | 10/2006 | Kim et al. | 313/485 |
| 2007/0194686 | A1 * | 8/2007 | Kwon et al. | 313/485 |
| 2007/0252527 | A1 | 11/2007 | Choi et al. | |
| 2009/0224669 | A1 * | 9/2009 | Park et al. | 313/582 |

FOREIGN PATENT DOCUMENTS

| | | |
|---|---|---|
| JP | 2002-208355 | 7/2002 |
| JP | 2003-257314 | 9/2003 |
| JP | 2005-71954 | 3/2005 |
| JP | 2008-31429 | 2/2008 |
| KR | 10-2007-0105512 | 10/2007 |

OTHER PUBLICATIONS

International Search Report issued Oct. 20, 2009 in International (PCT) Application No. PCT/JP2009/004682.

* cited by examiner

*Primary Examiner* — Bumsuk Won
(74) *Attorney, Agent, or Firm* — Wenderoth, Lind & Ponack, L.L.P.

(57) ABSTRACT

A plasma display panel has a front substrate, a rear substrate, and a phosphor layer. The front substrate has a dielectric layer formed so as to cover a plurality of display electrodes disposed on a substrate, and a protective layer formed on the dielectric layer. The rear substrate is faced to the front substrate so as to form discharge space, has data electrodes in the direction intersecting with the display electrodes, and has barrier ribs for partitioning the discharge space. The phosphor layer is formed by applying phosphor ink that is made of a phosphor material and dispersant between the barrier ribs of the rear substrate. Nano-particles with a diameter of a range of 1 nm to 100 nm inclusive, or a solvent having an affinity for the dispersant of the phosphor ink is applied to the surfaces of the barrier ribs, and then the phosphor ink is applied to them, thereby forming the phosphor layer.

7 Claims, 6 Drawing Sheets

PLASMA DISPLAY PANEL

BACKGROUND OF THE INVENTION

I. Technical Field

THIS APPLICATION IS A U.S. NATIONAL PHASE APPLICATION OF PCT INTERNATIONAL APPLICATION PCT/JP2009/004682.

II. Description of the Related Art

Recently, as a color display device capable of achieving a large screen, thinning, and lightness in weight, a plasma display panel (hereinafter referred to as "PDP") has received attention.

An AC surface discharge type PDP typical as a PDP has many discharge cells between a front substrate and a rear substrate that are faced to each other. The front substrate has the following elements:

- a plurality of display electrode pairs disposed in parallel on a glass substrate; and
- a dielectric layer and a protective layer for covering the display electrode pairs.

Here, each display electrode pair is formed of a pair of scan electrode and sustain electrode. The protective layer is a thin film made of alkaline earth oxide such as magnesium oxide (MgO), protects the dielectric layer from ion spatter, and stabilizes the discharge characteristic such as discharge start voltage. The rear substrate has the following elements:

- a plurality of data electrodes disposed in parallel on a glass substrate;
- a dielectric layer for covering the data electrodes;
- mesh barrier ribs disposed on the dielectric layer; and
- phosphor layers disposed on the surface of the dielectric layer and on side surfaces of the barrier ribs.

The front substrate and rear substrate are faced to each other so that the display electrode pairs and the data electrodes three-dimensionally intersect, and are sealed. Discharge gas is filled into a discharge space in the sealed product. Discharge cells are disposed in intersecting parts of the display electrode pairs and the data electrodes. In the PDP having this structure, ultraviolet rays are emitted by gas discharge in each discharge cell. The ultraviolet rays excite respective phosphors of red, green, and blue to emit light, and thus provide color display.

A subfield method is generally used as a method of driving the PDP. In this method, one field period is divided into a plurality of subfields, and the subfields in which light is emitted are combined, thereby performing gradation display. Each subfield has an initializing period, an address period, and a sustain period. In the initializing period, initializing discharge is caused in each discharge cell, and wall charge required for a subsequent address operation is formed. In the address period, address discharge is selectively caused in a discharge cell to perform display, and wall charge required for a subsequent sustain discharge is formed. In the sustain period, sustain pulses are alternately applied to the scan electrodes and the sustain electrodes, sustain discharge is caused in the discharge cell having undergone address discharge, and light is emitted in the phosphor layer of the corresponding discharge cell, thereby performing image display.

In such a PDP, when the size between the barrier ribs is decreased in order to respond to improvement in definition or the panel is enlarged in order to enlarge the screen, influence such as distortion of the glass substrate increases. Therefore, it is difficult to accurately apply phosphor paste between the barrier ribs. As a result, the phosphor paste adheres to the tops of the barrier ribs or different phosphor pastes come between adjacent barrier ribs, thereby causing a problem of color mixing.

Therefore, an ink jet method allowing accurate application is disclosed (Unexamined Japanese Patent Publication No. 2005-71954). In this method, a phosphor is dispersed in an organic solvent, and ink of viscosity of 10 cP or lower, for example, is produced and delivered from the head tip of the ink jet. Therefore, this method allows position control during application, and can respond to fining of the gaps between the barrier ribs and distortion of the glass substrate.

When a phosphor is formed in such a method, however, a problem is found that many pore parts existing on or in the barrier ribs cause variation in adhering amount of the phosphor adhering to the wall surfaces of the barrier ribs.

SUMMARY OF THE INVENTION

A plasma display panel of the present invention has a front substrate, a rear substrate, and a phosphor layer. The front substrate has a dielectric layer formed so as to cover a plurality of display electrodes disposed on a substrate, and a protective layer formed on the dielectric layer. The rear substrate is faced to the front substrate so as to form discharge space, has data electrodes in the direction intersecting with the display electrodes, and has barrier ribs for partitioning the discharge space. The phosphor layer is formed by applying phosphor ink that is made of a phosphor material and dispersant between the barrier ribs of the rear substrate. Nano-particles with a diameter of the range of 1 nm to 100 nm inclusive, or a solvent having an affinity for the dispersant of the phosphor ink is applied to the surfaces of the barrier ribs, and then the phosphor ink is applied to them, thereby forming the phosphor layer.

In such a structure, the phosphor layer of sufficient thickness can be stuck to side walls of the barrier ribs, and thus a PDP that has no irregularity, high definition, and a large screen can be easily achieved.

DETAILED DESCRIPTION OF THE INVENTION

First Exemplary Embodiment

Figure 1:
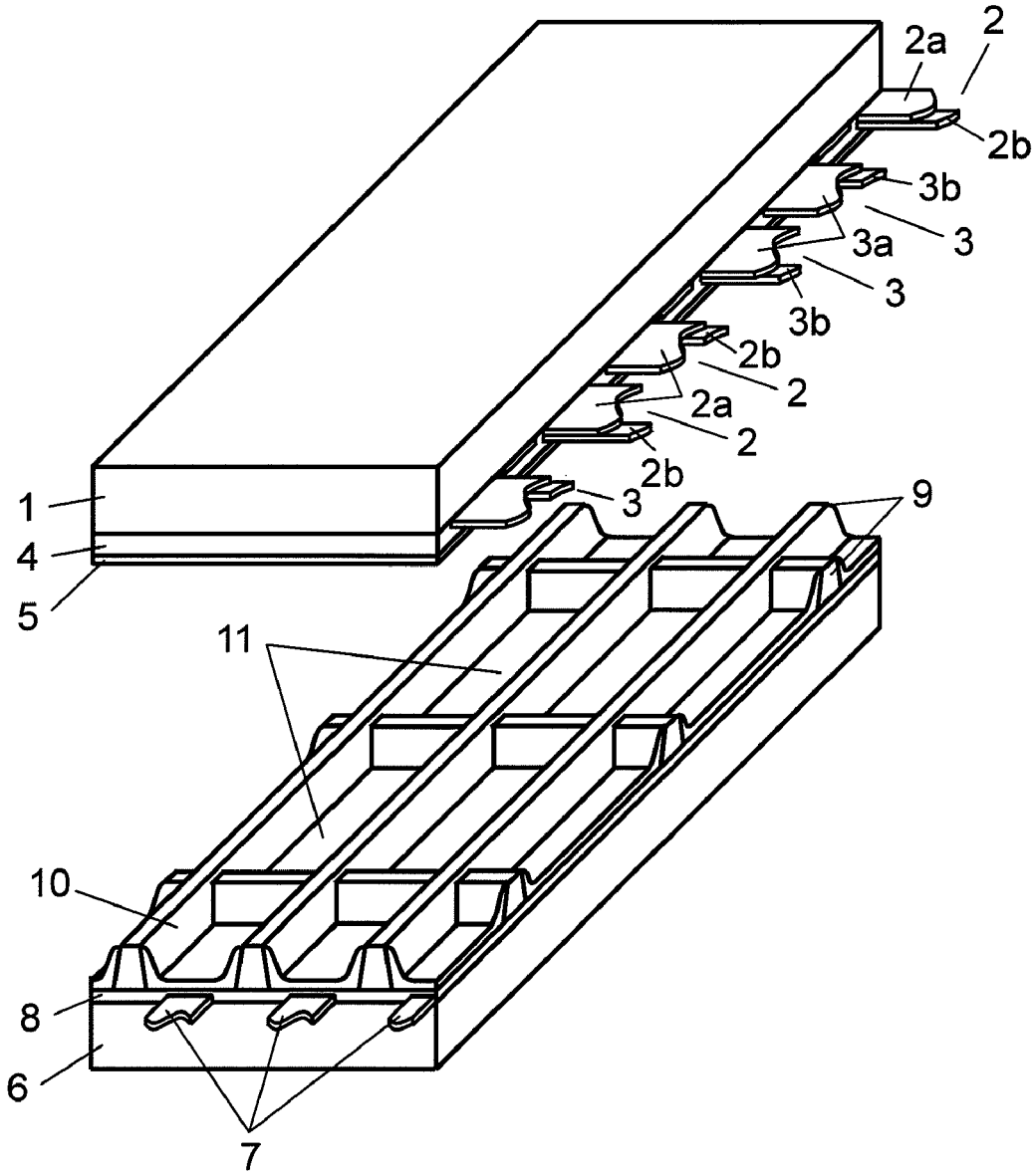
FIG. 1 is an exploded perspective view showing a structure of a PDP in accordance with a first exemplary embodiment of the present invention.
Figure 2:
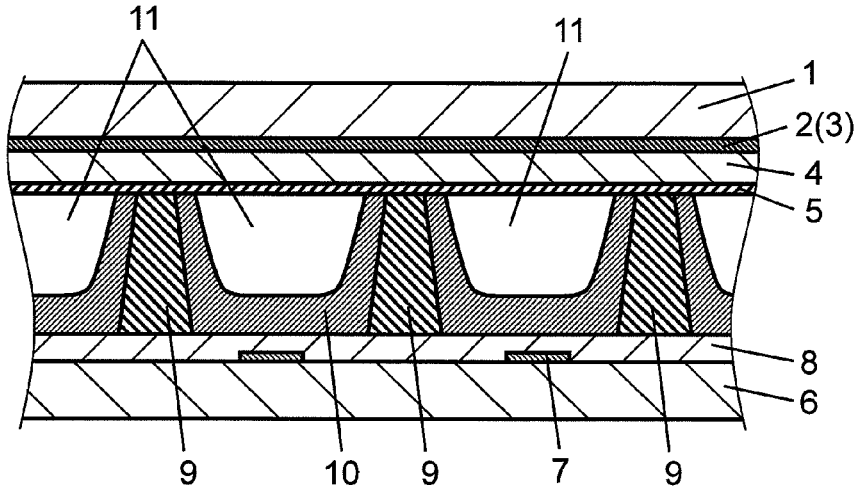
FIG. 2 is a sectional view showing a discharge cell part of the PDP in accordance with the first exemplary embodiment.

FIG. 1 is an exploded perspective view showing a structure of a PDP in accordance with a first exemplary embodiment of the present invention. FIG. 2 is a sectional view showing an essential part of the discharge cell 11 part.

As shown in FIG. 1, the PDP has many discharge cells 11 between a front plate and a rear plate that are faced to each other.

The front plate has a plurality of display electrodes disposed in parallel on a glass-made front substrate 1. Each display electrode is formed of a pair of scan electrode 2 and sustain electrode 3. Scan electrodes 2 and sustain electrodes 3 are repeatedly disposed in the order of the array of scan electrode 2-sustain electrode 3-sustain electrode 3-scan electrode 2. Dielectric layer 4 and protective layer 5 made of MgO are formed so as to cover the display electrodes. Scan electrode 2 and sustain electrode 3 are produced by forming bus electrodes 2*b* and 3*b* made of Ag on transparent electrodes 2*a* and 3*a* that are made of conductive metal oxide such as ITO, $SnO_2$, or ZnO.

The rear plate has the following elements:

- a plurality of parallel data electrodes 7 made of conductive material mainly containing Ag that are formed on rear substrate 6 made of glass;
- dielectric layer 8 formed so as to cover data electrodes 7;
- mesh barrier ribs 9 formed on the dielectric layer; and
- phosphor layers 10 of red, green, and blue that are formed on the surface of dielectric layer 8 and on side surfaces of barrier ribs 9.

In phosphor layers 10, $BaMgAl_{12}O_{17}:Eu^{3+}$ is used as blue phosphor, $Zn_2SiO_4$:Mn or $YBO_3$:Tb is used as green phosphor, and $YBO_3:Eu^{3+}$ is used as red phosphor. However, the present invention is not limited to the above-mentioned phosphors. The particle diameter of the phosphors is about 1 to 10 μm. The phosphor paste for forming phosphor layers 10 is produced by mixing and dispersing the above-mentioned phosphor particles in solution where butyl carbitol acetate, terpineol, and ethylcellulose are dissolved. Preferably, the viscosity of the phosphor paste is controlled based on the molecular weight and content of ethylcellulose so that it is 100 cP or lower. The dispersant is made of material of acrylic copolymer, alkyl ammonium salt group, or siloxane group. As discussed above, phosphor layers 10 are formed by applying the phosphor ink that is made of the phosphor material and dispersant between barrier ribs 9 of rear substrate 6.

The front plate and the rear plate are faced to each other so that scan electrodes 2 and sustain electrode 3 three-dimensionally intersect with data electrodes 7, their periphery is sealed, and the internal discharge space is filled with discharge gas, thereby forming a panel.

As shown in FIG. 2, scan electrodes 2 and sustain electrode 3 face data electrodes 7 in the discharge space surrounded by the front plate and the rear plate, and discharge cells 11 are formed in parts surrounded by barrier ribs 9.

Figure 3:
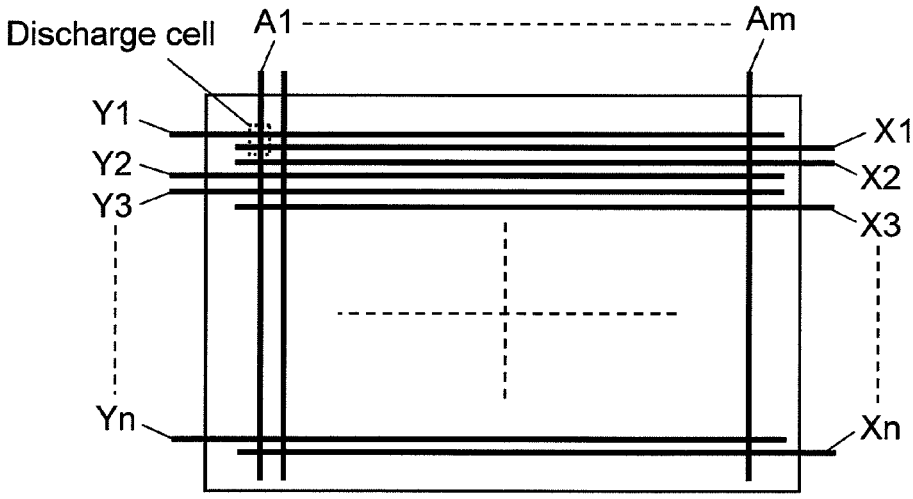
FIG. 3 is a diagram showing an electrode array of the PDP in accordance with the first exemplary embodiment.

FIG. 3 is an electrode array diagram of the PDP in accordance with the exemplary embodiment of the present invention. The PDP has n scan electrodes Y1, Y2, Y3, . . . , Yn (scan electrodes 2 in FIG. 1) and n sustain electrodes X1, X2, X3, . . . , Xn (sustain electrodes 3 in FIG. 1) both extended in the row direction, and m data electrodes A1, . . . , Am (data electrodes 7 in FIG. 1) extended in the column direction. Discharge cell 11 is formed in the part where a pair of scan electrode Y1 and sustain electrode X1 intersect with one data electrode A1. Thus, m×n discharge cells 11 are formed in the discharge space. Each electrode is connected to each of connection terminals disposed at peripheral ends of the front plate and the rear plate out of the image display region.

Figure 4:
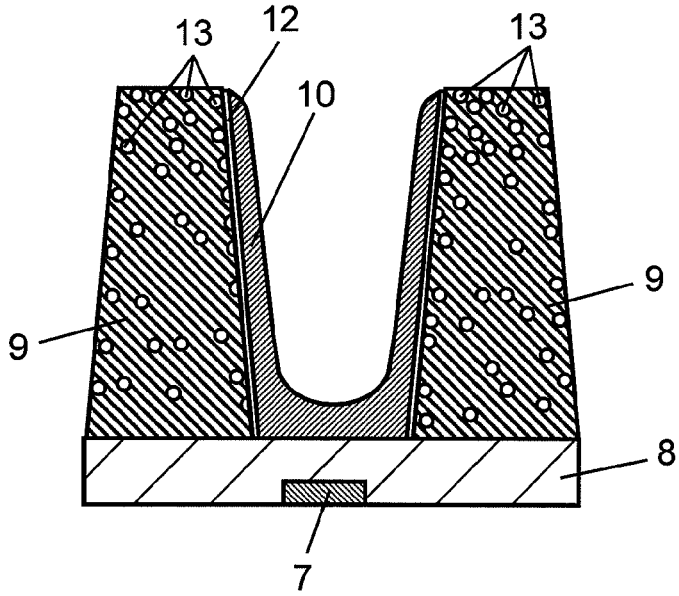
FIG. 4 is a sectional view showing an essential part of the PDP in accordance with the first exemplary embodiment.

In the present invention, as shown in FIG. 4, when phosphor paste is applied between barrier ribs 9 and is fired to form phosphor layers 10, nano-particle films 12 are firstly disposed on the surfaces of barrier ribs 9, then the phosphor paste is applied, and phosphor layers 10 are formed.

Figure 5:
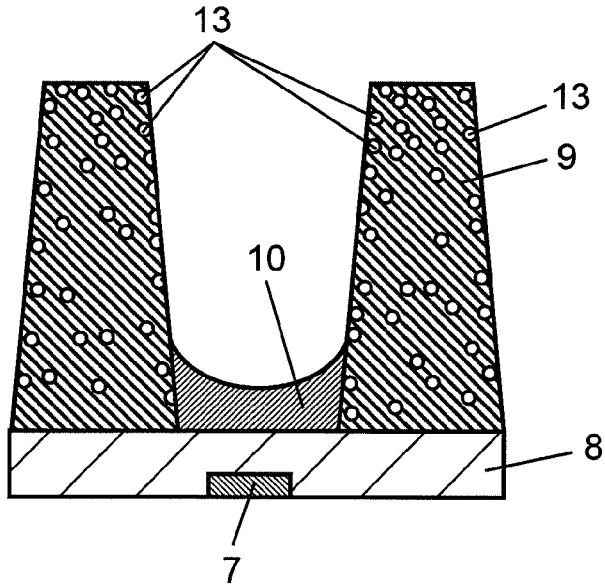
FIG. 5 is a sectional view showing an essential part of the PDP by a comparative example for illustrating an effect of the present invention.

When the present inventors perform an experiment of forming phosphor layers 10 using phosphor paste of low viscosity, as shown in FIG. 5, phosphor layers 10 are sometimes formed only on the bottoms of barrier ribs 9. When the inventors study this fact, it becomes clear that a plurality of pore parts 13 exist on and in barrier ribs 9. It therefore becomes clear that, when phosphor layers 10 are formed using phosphor paste of low viscosity, the phosphor paste is absorbed by pore parts 13 in the surfaces of barrier ribs 9 because of its low viscosity. As a result, as shown in FIG. 5, it becomes clear that the adhering amount of phosphor layers 10 on wall surfaces of barrier ribs 9 varies, for example, phosphor layers 10 are formed only on the bottoms of barrier ribs 9.

Therefore, the inventors perform study for reducing variation in adhering amount of phosphor layers 10. As a result, it becomes clear that the variation can be reduced by firstly disposing nano-particle films 12 on the surfaces of barrier ribs 9, then applying the phosphor paste, and forming phosphor layer 10 when the phosphor paste is applied between barrier ribs 9 and is fired to form phosphor layers 10.

Nano-particle films 12 formed on the surfaces of barrier ribs 9 in the PDP of the present invention are required to be formed by coating the side surfaces of barrier ribs 9 with paste or ink that is obtained using nano-particles with diameters of the range of 1 nm to 100 nm inclusive. Thus, nano-particle films 12 are formed in pore parts 13 existing in the side surfaces of barrier ribs 9. As a result, the phenomenon that later formed phosphor layers 10 are absorbed by pore parts 13 in barrier ribs 9 can be suppressed. Therefore, as shown in FIG. 4, phosphor layers 10 can be formed sufficiently up to the upper parts of barrier ribs 9. As the material for the nano-particles, particles having positive charge or negative charge are required to be used in response to phosphor particles constituting phosphor layers 10 of red, green, and blue. For example, the surface potential of the green phosphor is charged negatively, and the surface potentials of the red phosphor and blue phosphor are charged positively. Therefore, in response to the surface potential of the phosphor particles, one selected from BaO, MgO, and ZnO having positive charge or one selected from CuO, $SiO_2$, $SnO_2$, $V_2O_5$, NiO, $Fe_2O_3$, $Cr_2O_3$, and $CeO_2$ having negative charge is used as the material for the nano-particles.

As another embodiment of the present invention, the structure may be used where reflecting films are formed of nano-particle films 12 disposed on the surfaces of barrier ribs 9 and phosphor layers 10 are formed on the reflecting films.

Specifically, phosphor layers 10 are required to be formed by coating the side surfaces of barrier ribs 9 with paste or ink that is obtained using nano-particles with diameters of the range of 1 nm to 100 nm inclusive. Thus, reflecting films can be formed by filling nano-particles into pores 9*a* existing in the side surfaces of barrier ribs 9 and further depositing nano-particles on them. As a result, the phenomenon that later formed phosphor layers 10 are absorbed by pores 9*a* in barrier ribs 9 can be suppressed. The reflecting films by nano-particle films 12 are formed also on dielectric layer 8 of the rear plate.

Ultraviolet rays generated by discharge are absorbed by the outermost surface part (about 0.1 μm from the surface) of phosphor layers 10, and excite the phosphor, thereby emitting light from the phosphor. This light is not entirely released from phosphor layers 10 in the front direction on the discharge space side, but part of the light is released toward dielectric layer 8 of the rear plate. However, in the structure of the present invention, the dense surfaces of nano-particle films 12 face the phosphor layers 10, and hence the dense surfaces of nano-particle films 12 can reflect the light, which has been released toward the rear surface, more certainly toward the front surface.

As the method of forming nano-particle films 12, a general coating method such as a screen printing, dispenser method, or ink jet method can be used. However, for improving the definition, the ink jet method is preferable.

When nano-particle ink is applied, the ink is absorbed by pores 9*a* existing in barrier ribs 9. At this time, the nano-particles are preferentially absorbed by pores 9*a*. Pores 9*a* are filled with the nano-particles, and, as time goes by, nano-particles are sequentially and continuously deposited on the nano-particles filled into pores 9*a*. As a result, a reflecting film as a dense aggregate of nano-particles is formed. The thickness and density of the reflecting film by nano-particle films 12 depend on the amount of nano-particles in the nano-particle ink and the type and amount of the dispersant. However, preferably, the thickness of the reflecting film is between 0.1 μm and 10 μm inclusive.

Second Exemplary Embodiment

In the first exemplary embodiment of the present invention, the phosphor ink made of a phosphor material and dispersant is applied between barrier ribs 9 to form phosphor layers 10. However, instead of the method of using nano-particles, a method of applying a solvent having a high affinity for the dispersant of the phosphor ink may be employed. The solvent having a high affinity for the dispersant of the phosphor ink is firstly applied to barrier ribs 9, then the phosphor ink is applied on them to form phosphor layers 10. Hereinafter, one example of the manufacturing method of forming phosphor layers 10 in the PDP of the present invention is described. In the PDP of the second exemplary embodiment, elements similar to those in the first exemplary embodiment are denoted with the same reference marks, and the descriptions of those elements are omitted.

Figure 6A:
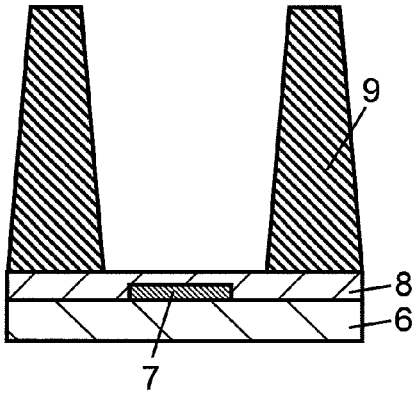
FIG. 6A is a sectional view showing a state of a process of an essential part in a manufacturing method of a PDP in accordance with a second exemplary embodiment of the present invention.

FIG. 6A through FIG. 8 are sectional views for illustrating the manufacturing method of a PDP in accordance with the second exemplary embodiment of the present invention. Barrier ribs 9 are firstly formed as shown in FIG. 6A, and then solvent 14 containing wet dispersant 14*a* is applied between barrier ribs 9 of the rear plate, for example, by about ⅔ of the internal volume of discharge cell 11 surrounded by barrier ribs 9 as shown in FIG. 6B. In this case, in consideration of the wetness of solvent 14 in the material for rear substrate 6 or the like, the dropping amount is determined.

Here, solvent 14 is made of butyl carbitol acetate when blue phosphor $BaMgAl_{10}O_{17}:Eu^{2+}$ is used as the material forming phosphor layers 10, for example. As a viscosity modifier allowing the delivery by ink jet, a binder such as Ethocel may be added by 0.1% or higher. Alkyl ammonium salt of block copolymer containing acid radical, as dispersant 14*a*, is added by 0.1 wt % or higher of solvent 14. As the component contained in solvent 14, an additive or surface adjustor may be added appropriately in consideration of the wetness with rear substrate 6.

Figure 6C:
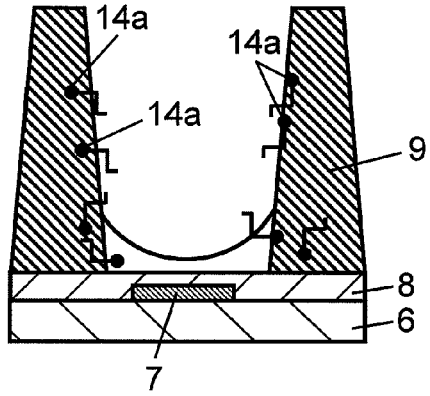
FIG. 6C is a sectional view showing yet another state of the process of the essential part in the manufacturing method of the PDP in accordance with the second exemplary embodiment of the present invention.
Figure 6B:
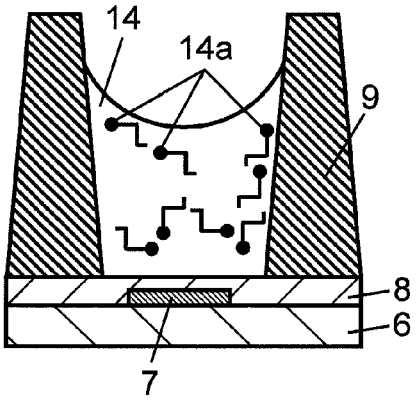
FIG. 6B is a sectional view showing another state of the process of the essential part in the manufacturing method of the PDP in accordance with the second exemplary embodiment of the present invention.

Next, as shown in FIG. 6C, the product of FIG. 6B is heated to 50° C. or higher, for example, to dry solvent 14 containing dispersant 14*a*. At this time, the heating is performed at a temperature at which the component such as dispersant 14*a* does not decompose. The heating temperature largely depends on the component, atmosphere, or exhaust rate of the solvent used for the ink. The ink is absorbed by barrier ribs 9 due to capillarity dependently on the size and porosity of pores existing in barrier ribs 9, so that heating is not required in some cases.

Figure 6D:
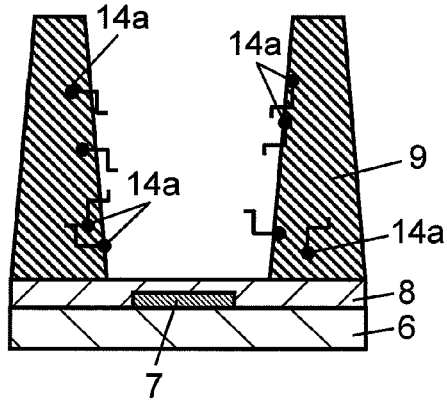
FIG. 6D is a sectional view showing still another state of the process of the essential part in the manufacturing method of the PDP in accordance with the second exemplary embodiment of the present invention.

This process results in that dispersant 14*a* is absorbed by or stuck to the surfaces of barrier ribs 9 as shown in FIG. 6D.

Figure 7A:
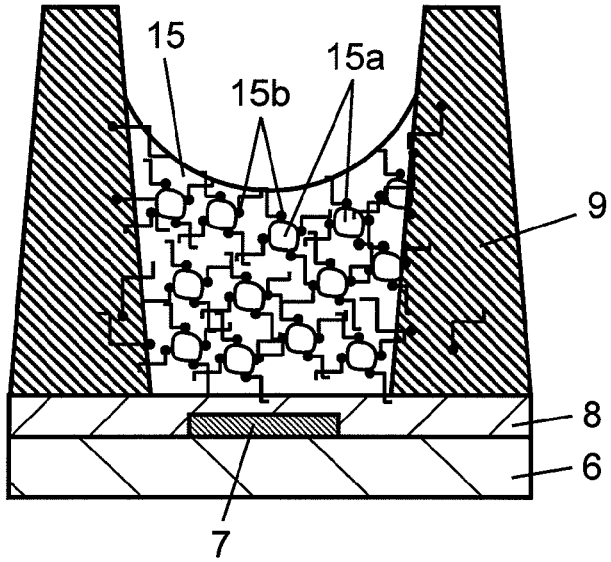
FIG. 7A is a sectional view showing a state of a process of the essential part in the manufacturing method of the PDP in accordance with the second exemplary embodiment.

Next, as shown in FIG. 7A, phosphor ink 15 for forming phosphor layers 10 is dropped, for example, by about ⅔ of the internal volume of discharge cell 11 surrounded by barrier ribs 9. In this case, in consideration of the wetness of phosphor ink 15 in the material for rear substrate 6 or the like, the amount of dropping ink is adjusted. Phosphor ink 15 contains phosphor material 15*a* forming phosphor layers 10 and dispersant 15*b* for dispersing phosphor material 15*a*.

Here, phosphor ink 15 is made of butyl carbitol acetate when blue phosphor. $BaMgAl_{10}O_{17}:Eu^{2+}$ is used as phosphor material 15*a* forming phosphor layers 10, for example. As a viscosity modifier allowing the delivery by ink jet, a binder such as Ethocel may be added by 0.1% or higher. Alkyl ammonium salt of block copolymer containing acid radical, as dispersant 15*b*, is added by 0.1 wt % or higher of phosphor ink 15. As the component contained in the solvent of phosphor ink 15, an additive or surface adjustor may be added appropriately in consideration of the wetness with rear substrate 6.

Figure 7B:
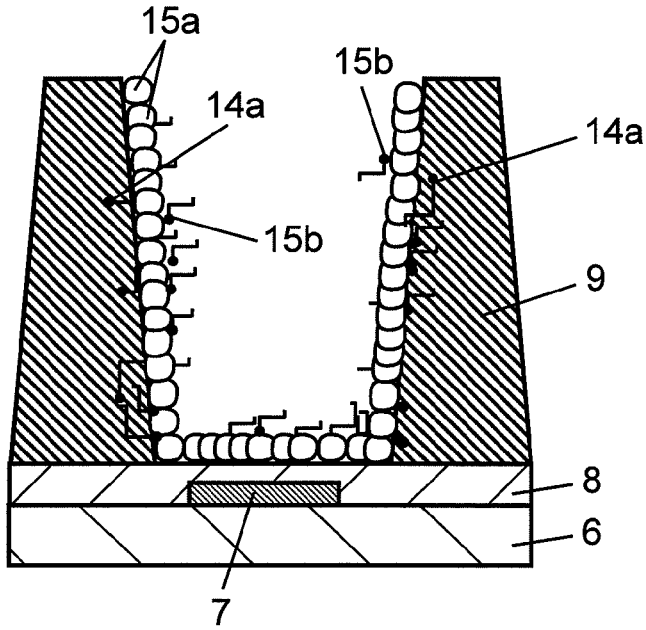
FIG. 7B is a sectional view showing another state of the process of the essential part in the manufacturing method of the PDP in accordance with the second exemplary embodiment.

Next, as shown in FIG. 7B, the product of FIG. 7A is heated to 50° C. or higher, for example, to dry phosphor ink 15 containing phosphor material 15*a* and dispersant 15*b*. At this time, the heating is performed at a temperature at which the component such as dispersant 15*b* does not decompose.

Especially, in the present invention, thanks to the process using the above-mentioned component of dispersant 15*b*, dispersant 15*b* has terminal groups of acid radical and base, and hence has a high affinity for acid radical and base and is apt to react with each terminal group of dispersant 14*a* adhering to the surfaces of barrier ribs 9. Therefore, even when phosphor ink 15 for ink jet of low viscosity is made of a material that has a high sedimentation rate and a diameter of 1 μm or larger and forms a reflecting film, the phosphor ink can sufficiently cover barrier ribs 9 after the drying process.

Figure 8:
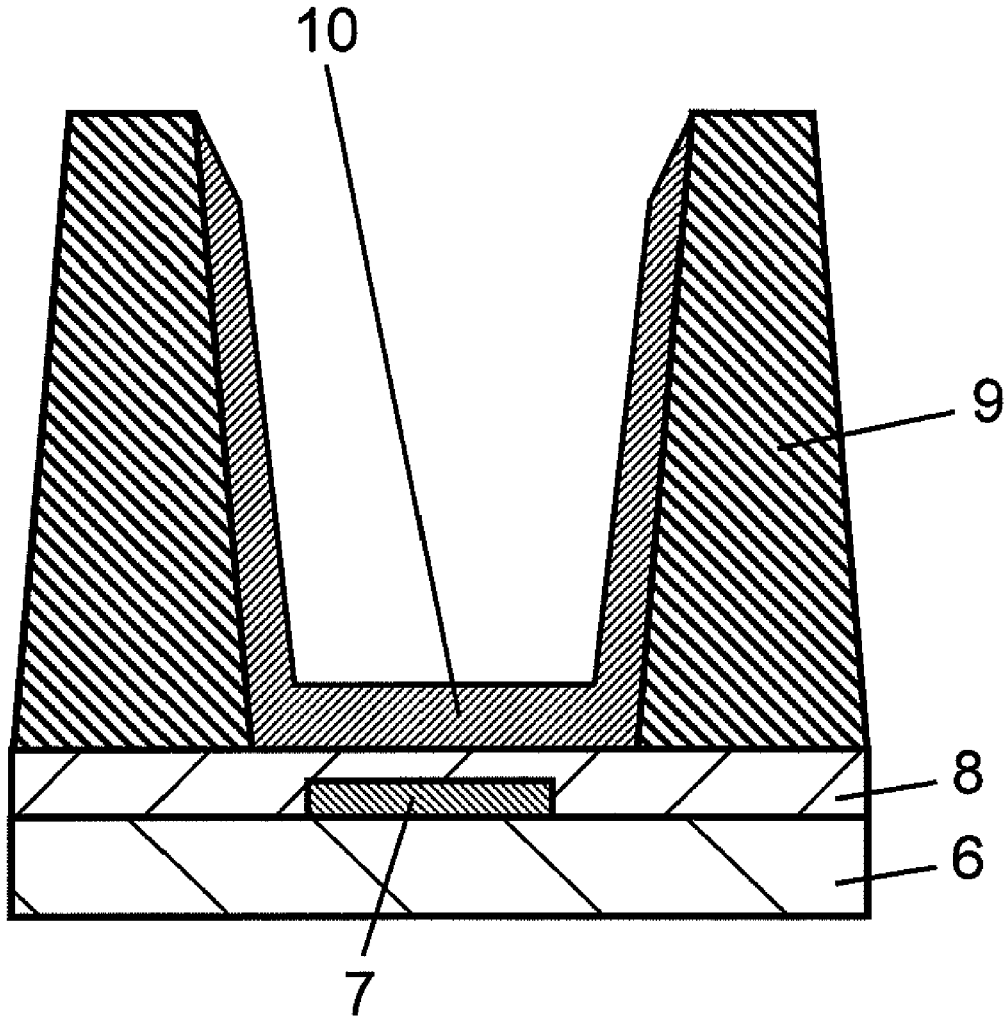
FIG. 8 is a sectional view for illustrating a state after a phosphor layer is formed in the manufacturing method of the PDP in accordance with the second exemplary embodiment.

Next, as shown in FIG. 8, a process of firing phosphor ink 15 by heating at 100° C. or higher is performed, thereby completing the rear plate of the PDP. This firing allows sufficient decomposition of the diffusing dispersant component, and hence can reduce the influence on the device characteristic.

Here, the heating temperature largely depends on the component, atmosphere, or exhaust rate of the solvent used for the ink. The ink is absorbed by barrier ribs 9 due to capillarity dependently on the size and porosity of the pores existing in barrier ribs 9, so that heating is not required in some cases.

In the present embodiment, the affinity between barrier ribs 9 and phosphor ink 15 is made sufficient by applying, to barrier ribs 9, the solvent having an affinity for the dispersant of the phosphor ink. However, sufficiently thick phosphors may be stuck to the side walls of barrier ribs 9 by employing phosphor ink 15 having an affinity for barrier ribs 9 by itself.

Specifically, in phosphor ink 15, when the zeta potential of the material for barrier ribs 9 is negative and blue phosphor $BaMgAl_{10}O_{17}:Eu^{2+}$ is used as phosphor material 15*a* forming phosphor layers 10, for example, acrylic copolymer that has positive zeta potential and an affinity is added as dispersant 15*b* by 0.1 wt % or higher of the ink. Phosphor ink 15 may be made of butyl carbitol acetate, and, as a viscosity modifier allowing the delivery by ink jet, a binder such as Ethocel may be added by 0.1% or higher. When the zeta potential of the material for barrier ribs 9 is positive, dispersant 15*b* whose zeta potential is negative, oppositely, is employed. In other words, preferably, phosphor ink 15 contains dispersant 15*b* having zeta potential opposite to that of the material for barrier ribs 9. As the component contained in the solvent of the ink, an additive or surface adjustor may be added appropriately in consideration of the wetness with rear substrate 6.

Especially, since dispersant 15*b* has positive or negative zeta potential when the above-mentioned process is performed using the above-mentioned component thereof, dispersant 15*b* has a high affinity for the material for barrier ribs 9 and is apt to react with the material for barrier ribs 9. Therefore, even when the ink of low viscosity for ink jet is made of a material that has a high sedimentation rate and a diameter of 1 μm or larger and forms phosphor layers 10, a sufficient amount of ink can be stuck to the side surfaces of barrier ribs 9 after the drying process.

The plasma display panel of the present invention is useful for easily achieving a high-definition PDP with a large screen.

The invention claimed is:

1. A plasma display panel comprising:

a front plate including a front substrate, a plurality of display electrodes disposed on the front substrate, a dielectric layer disposed so as to cover the plurality of display electrodes, and a protective layer disposed on the dielectric layer; and a rear plate facing the front plate so as to form a discharge space, the rear plate including a rear substrate, a plurality of data electrodes disposed on the rear substrate in a direction intersecting with the display electrodes, barrier ribs partitioning the discharge space, the barrier ribs including pores, nano-particles absorbed and disposed in the pores by being coated on a surface of the barrier ribs, the nano-particles having a diameter of 1 nm to 100 nm inclusive, and a phosphor layer formed by applying phosphor ink between the barrier ribs, the phosphor ink being a phosphor material and a dispersant, wherein a charge of the nano-particles is the same as a charge of the phosphor material.

2. The plasma display panel of claim 1, wherein the phosphor ink contains a dispersant having zeta potential that is opposite to zeta potential of a material for the barrier ribs.

3. The plasma display panel of claim 1, wherein the dispersant is an alkyl ammonium salt of block copolymer containing acid radical.

4. A plasma display panel comprising:

a front plate including a front substrate, a plurality of display electrodes disposed on the front substrate, a dielectric layer disposed so as to cover the plurality of display electrodes, and a protective layer disposed on the dielectric layer; and a rear plate facing the front plate so as to form a discharge space, the rear plate including a rear substrate, a plurality of data electrodes disposed on the rear substrate in a direction interesting with the display electrodes, barrier ribs partitioning the discharge space, the barrier ribs including pores, nano-particles absorbed and disposed in the pores by being coated on a surface of the barrier ribs, and a phosphor layer formed by applying phosphor ink between the barrier ribs, the phosphor ink being a phosphor material and a dispersant, the dispersant being an alkyl ammonium salt of block copolymer containing acid radical.

5. The plasma display panel of claim 4, wherein the phosphor ink contains a dispersant having zeta potential that is opposite to zeta potential of a material for the barrier ribs.

6. The plasma display panel of claim 4, wherein the rear plate further includes nano-particles with a diameter of 1 nm to 100 nm inclusive absorbed by pores in the barrier ribs.

7. The plasma display panel of claim 6, wherein the nano-particles have the same charge as the phosphor material.

* * * * *